US007126292B2

(12) United States Patent
Morimoto et al.

(10) Patent No.: US 7,126,292 B2
(45) Date of Patent: Oct. 24, 2006

(54) CATHODE-RAY TUBE APPARATUS

(75) Inventors: Hiroji Morimoto, Kashihara (JP); Koji Nishiyama, Ibaraki (JP); Katsuyo Iwasaki, Nishinomiya (JP); Akira Satou, Ibaraki (JP); Kenichiro Taniwa, Takatsuki (JP)

(73) Assignee: Matsushita Toshiba Picture Display Co., Ltd., Osaka (JP)

( * ) Notice: Subject to any disclaimer, the term of this patent is extended or adjusted under 35 U.S.C. 154(b) by 115 days.

(21) Appl. No.: 11/069,071

(22) Filed: Mar. 1, 2005

(65) Prior Publication Data

US 2005/0206329 A1 Sep. 22, 2005

(30) Foreign Application Priority Data

Mar. 16, 2004 (JP) ..... 2004-074976

(51) Int. Cl.
*G09G 1/04* (2006.01)
*H01J 29/70* (2006.01)

(52) U.S. Cl. ..... 315/399; 315/391; 315/364; 313/440; 313/413

(58) Field of Classification Search ..... None
See application file for complete search history.

(56) References Cited

U.S. PATENT DOCUMENTS 3,031,405 A 4/1962 Pierrot et al.
4,431,979 A 2/1984 Stijntjes et al.
5,621,287 A 4/1997 Dossot et al.
5,708,323 A 1/1998 Okamoto
6,307,333 B1 * 10/2001 Sluyterman et al. ... 315/368.28
2003/0030361 A1 2/2003 Hirota et al.
2004/0155611 A1 * 8/2004 Sakurai et al. ..... 315/368.15

FOREIGN PATENT DOCUMENTS

| | | |
|---|---|---|
| EP | 0 621 626 | 4/1993 |
| EP | 0 901 147 | 3/1999 |
| EP | 1 117 123 | 7/2001 |
| EP | 1 460 673 | 9/2004 |
| JP | 57-45650 | 10/1982 |
| JP | 6-283113 | 10/1994 |
| JP | 2003-116019 | 4/2003 |

* cited by examiner

*Primary Examiner*—Tuyet Thi Vo
(74) *Attorney, Agent, or Firm*—Hamre, Schumann, Mueller & Larson, P.C.

(57) ABSTRACT

A deflection coil for deflecting an electron beam emitted from an electron gun is provided outside a cathode-ray tube in which the electron gun is housed, and a phosphor screen is formed. The cathode-ray tube further includes a velocity modulation coil for modulating a horizontal scanning velocity of an electron beam, a first magnetic substance surrounding an outer circumference of the cathode-ray tube from outside the velocity modulation coil, and a second magnetic substance surrounding the outer circumference of the cathode-ray tube between the deflection coil and the first magnetic substance. Because of this, the sensitivity of velocity modulation can be enhanced effectively with a simple configuration while deflection distortion is prevented.

10 Claims, 7 Drawing Sheets

CATHODE-RAY TUBE APPARATUS

BACKGROUND OF THE INVENTION

1. Field of the Invention

The present invention relates to a cathode-ray tube apparatus used in a TV receiver, a computer display, and the like, and in particular, to a cathode-ray tube apparatus provided with a velocity modulation coil.

2. Description of the Related Art

As one method for realizing higher image quality in a TV receiver, for example, there is the enhancement of an edge of an image. In order to enhance an edge of an image, a velocity modulation coil is provided in a cathode-ray tube apparatus. The velocity modulation coil is provided at a neck of a cathode-ray tube or in the vicinity thereof, and generates a magnetic field in a vertical direction to modulate the horizontal scanning velocity of an electron beam, thereby enhancing an edge of an image (e.g., see JP 57(1982)-45650 U).

In the color cathode-ray tube apparatus, the increase in a diameter of an electron beam spot on a phosphor screen ascribed to the recent enlargement of a screen, the increase in an anode voltage for higher brightness, and the enhancement in flatness of a front panel are proceeding. Along with these, there is a demand for a further higher intensity in a magnetic field for enhancing an edge of an image.

Under the above-mentioned circumstances, a color cathode-ray tube apparatus has been proposed that is capable of increasing the intensity of a magnetic field acting on an electron beam without increasing a current that flows through a velocity modulation coil and without increasing the winding number of the velocity modulation coil (e.g., see JP 6(1994)-283113 A).

In the color cathode-ray tube apparatus described in JP 6(1994)-283113 A, magnetic substances are placed in upper and lower portions of respective electron beam passage apertures for three electron beams (R, G, B) provided in a fifth grid (G5 electrode) of an electron gun housed in a neck, and a velocity modulation coil is placed at a position on an outer circumference of the neck corresponding to the G5 electrode.

According to the above configuration, a magnetic flux generated in the velocity modulation coil is focused by the magnetic substances, and the magnetic flux can be concentrated in an electron beam passage region, whereby the intensity of a magnetic field contributing to the velocity modulation of electron beams can be increased.

However, due to the loss caused by an eddy current generated on the surface of the electrode (G5 electrode) that is a metal component, the intensity of a magnetic field generated in the electron beam passage region in the G5 electrode is inherently low. Thus, even if such a magnetic field with a low intensity is increased by the magnetic substances, the effect thereof cannot be expected sufficiently. That is, in the color cathode-ray tube apparatus of JP 6(1994)-283113 A, the sensitivity of velocity modulation (velocity modulation amount of an electron beam with respect to an input current to the velocity modulation coil) is not so enhanced as expected. Furthermore, the magnetic substances and the G5 electrode are welded to each other, so that the number of processes for welding such small components to each other is large, which increases the production cost.

Furthermore, a deflection magnetic field generated by a horizontal deflection coil and a vertical deflection coil for allowing electron beams emitted from the electron gun to scan the phosphor screen is distributed to the electron gun side on which the velocity modulation coil is provided. Thus, it is desired to prevent the distribution of the deflection magnetic field from being influenced to cause deflection distortion by enhancing the sensitivity of velocity modulation.

SUMMARY OF THE INVENTION

The present invention solves the above-mentioned conventional problems, and its object is to provide a cathode-ray tube apparatus capable of effectively enhancing the sensitivity of velocity modulation with a simple configuration while preventing deflection distortion.

A cathode-ray tube apparatus of the present invention includes a cathode-ray tube in which an electron gun is housed and a phosphor screen is formed, and a deflection coil for deflecting an electron beam emitted from the electron gun, provided outside the cathode-ray tube. The cathode-ray tube apparatus further includes a velocity modulation coil for modulating a horizontal scanning velocity of the electron beam, a first magnetic substance surrounding an outer circumference of the cathode-ray tube from outside the velocity modulation coil, and a second magnetic substance surrounding the outer circumference of the cathode-ray tube, placed between the deflection coil and the first magnetic substance.

These and other advantages of the present invention will become apparent to those skilled in the art upon reading and understanding the following detailed description with reference to the accompanying figures.

DESCRIPTION OF THE PREFERRED EMBODIMENTS

Figure 1:
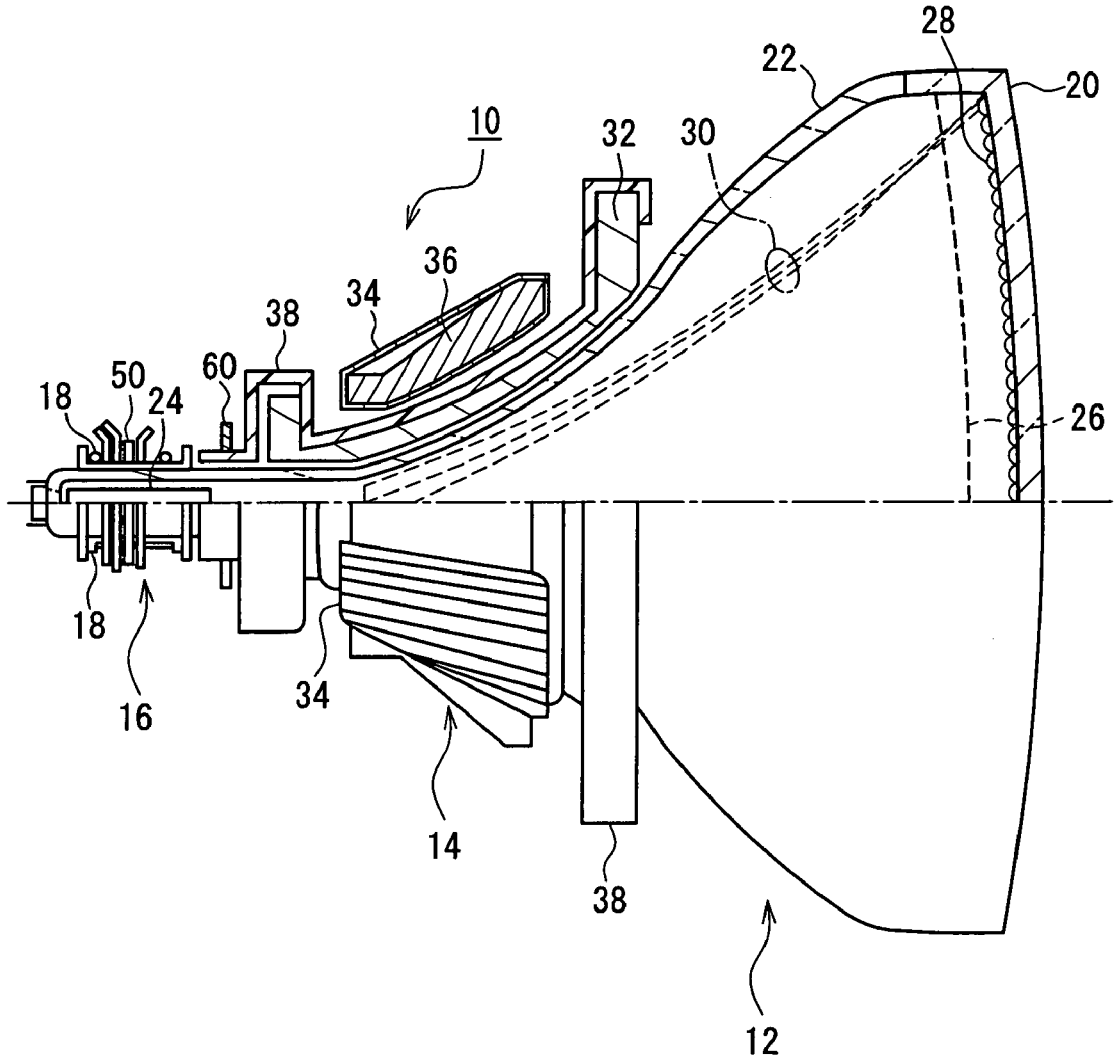
FIG. 1 is a partial cross-sectional view schematically showing a configuration of a color cathode-ray tube apparatus according to one embodiment of the present invention.

According to the present invention, the sensitivity of velocity modulation can be enhanced effectively with a simple configuration while deflection distortion is prevented.

In the above-mentioned cathode-ray tube apparatus of the present invention, it is preferable that the first and second magnetic substances are formed in an annular shape. According to this configuration, the outer circumference of the cathode-ray tube can be surrounded exactly.

Furthermore, it is preferable that the first magnetic substance is placed at a position corresponding to a gap between electrodes forming a main lens in the electron gun. According to this configuration, since the gap between the electrodes forming the main lens is large, the sensitivity of velocity modulation can be enhanced effectively.

Furthermore, it is preferable that a support frame for supporting the deflection coil extends to a portion where the electron gun is placed in a tube axis direction, and the first magnetic substance, the second magnetic substance, and the velocity modulation coil are attached to the support frame. According to this configuration, the support frame constituting the deflection yoke also can be used as the support frame for the first magnetic substance and the like, which simplifies the configuration.

Furthermore, it is preferable that an end portion of the velocity modulation coil on the phosphor screen side is positioned on the phosphor screen side with respect to an end on the phosphor screen side of a metal portion constituting the electron gun. According to this configuration, a magnetic flux of the velocity modulation coil can be generated in a section in which the metal component is not present, so that the sensitivity of velocity modulation can be enhanced.

Furthermore, it is preferable that the second magnetic substance is placed closer to the deflection coil than to the first magnetic substance. According to this configuration, the second magnetic substance can suppress a change in the distribution of a deflection magnetic field generated by the deflection coil, caused by providing the first magnetic substance. Furthermore, the deflection magnetic field generated by the deflection coil and the magnetic field generated by the velocity modulation coil can be prevented from interfering with each other to generate ringing.

Furthermore, it is preferable that the first magnetic substance is a sintered body of Ni—Zn ferrite. This configuration is advantageous for enhancing the sensitivity of velocity modulation.

Furthermore, it is preferable that the first magnetic substance is resin mixed with Ni—Zn ferrite type magnetic substance powder. According to this configuration, the cost can be reduced while the sensitivity of velocity modulation is enhanced.

Furthermore, it is preferable that the second magnetic substance is a sintered body of Ni—Zn ferrite. According to this configuration, the effect of weakening the magnetic field spreading to the electron gun side, among the magnetic field generated by the deflection coil, is large, which is advantageous for preventing deflection distortion.

Furthermore, it is preferable that the second magnetic substance is resin mixed with Ni—Zn ferrite type magnetic substance powder. According to this configuration, the cost can be reduced while deflection distortion is prevented.

Hereinafter, the present invention will be described by way of one embodiment with reference to the drawings. FIG. 1 is a partial cross-sectional view schematically showing a configuration of a color cathode-ray tube apparatus 10 according to one embodiment of the present invention. As shown in FIG. 1, the color cathode-ray tube apparatus 10 has a configuration in which a deflection yoke 14, a convergence and purity unit (CPU) 16, and a velocity modulation coil 18 are attached to an outer circumference of a color cathode-ray tube 12.

In the color cathode-ray tube 12, an in-line type electron gun (hereinafter, simply referred to as an "electron gun") 24, a shadow mask 26, and the like are housed in a glass bulb formed by connecting a face panel 20 to a funnel 22. On an inner surface of the face panel 20, a phosphor screen 28 is formed in which respective phosphor dots (or stripes) of red, green, and blue are arranged periodically. The shadow mask 26 is provided substantially in parallel to the phosphor screen 28. The shadow mask 26 is provided with a number of electron beam passage apertures, whereby three electron beams 30 emitted from the electron gun 24 strike the respective phosphors exactly.

The deflection yoke 14 is provided on an outer circumference of the funnel 22, and deflects the three electron beams 30 emitted from the electron gun 24 in vertical and horizontal directions to allow them to scan the phosphor screen 28 by a raster scan system. The deflection yoke 14 includes a saddle-type horizontal deflection coil 32 and a toroidal vertical deflection coil 34, and the vertical deflection coil 34 is wound around a ferrite core 36.

A resin frame (support frame) 38 is provided between the vertical deflection coil 34 and the horizontal deflection coil 32. The resin frame 38 maintains an electrically insulated state between the vertical deflection coil 34 and the horizontal deflection coil 32, and supports both the deflection coils 32, 34.

Figure 2A:
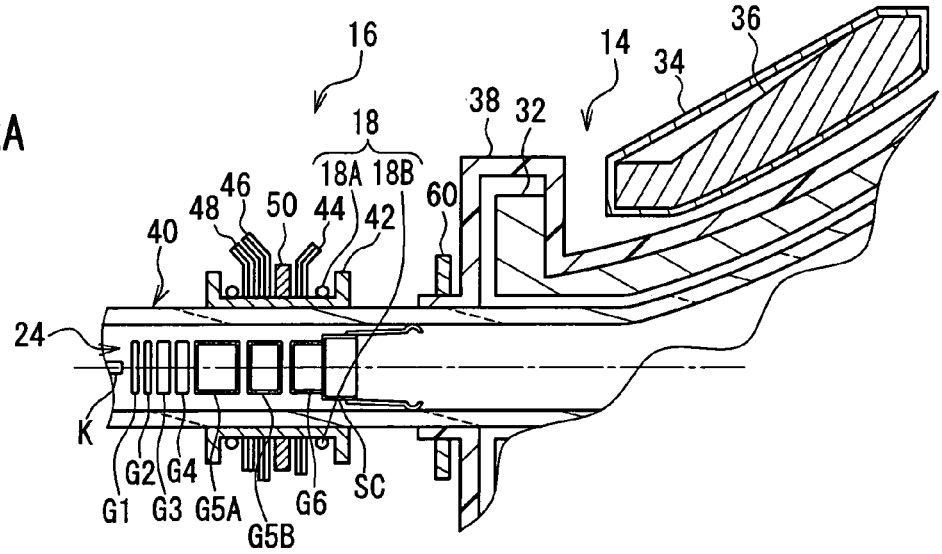
FIG. 2A is an enlarged cross-sectional view of a neck of the color cathode-ray tube apparatus shown in FIG. 1 and the vicinity thereof.

FIG. 2A is an enlarged cross-sectional view of the vicinity of a neck 40 in a cylindrical shape in the funnel 22. The electron gun 24 is housed inside the neck 40, and includes three cathodes K, electrodes G1, G2, G3, G4, G5A, G5B, and G6 arranged successively at a predetermined interval from each other, from the cathodes K to the phosphor screen 28 in a tube axis direction, and a shield cup SC attached to the electrode G6. The three cathodes K are heated respectively by three heaters (not shown). The cathodes K are arranged on a straight line in a direction orthogonal to the tube axis. Therefore, FIG. 2A shows only one cathode on the front side among the three cathodes K.

Furthermore, the electron gun 24 forms a main lens between the electrodes G5B and G6, and each electron beam is focused onto the phosphor screen 28 by the main lens.

The CPU 16 is provided at a position on an outer circumference of the neck 40 corresponding to the electron gun 24, and adjusts the static convergence and purity (color purification) of electron beams. The CPU 16 is composed of a cylindrical resin frame 42, and a purity magnet 44, a quadrupole magnet 46 and a hexapole magnet 48 attached to the resin frame 42. These magnets respectively are composed of one set of two magnets in an annular shape.

The velocity modulation coil 18 is composed of a pair of loop coils (hereinafter, simply referred to as a "coil") 18A and 18B. The coils 18A, 18B are attached to the resin frame 42 of the CPU 16. More specifically, the velocity modulation coil 18 is integrally attached to the CPU 16.

Figure 3A:
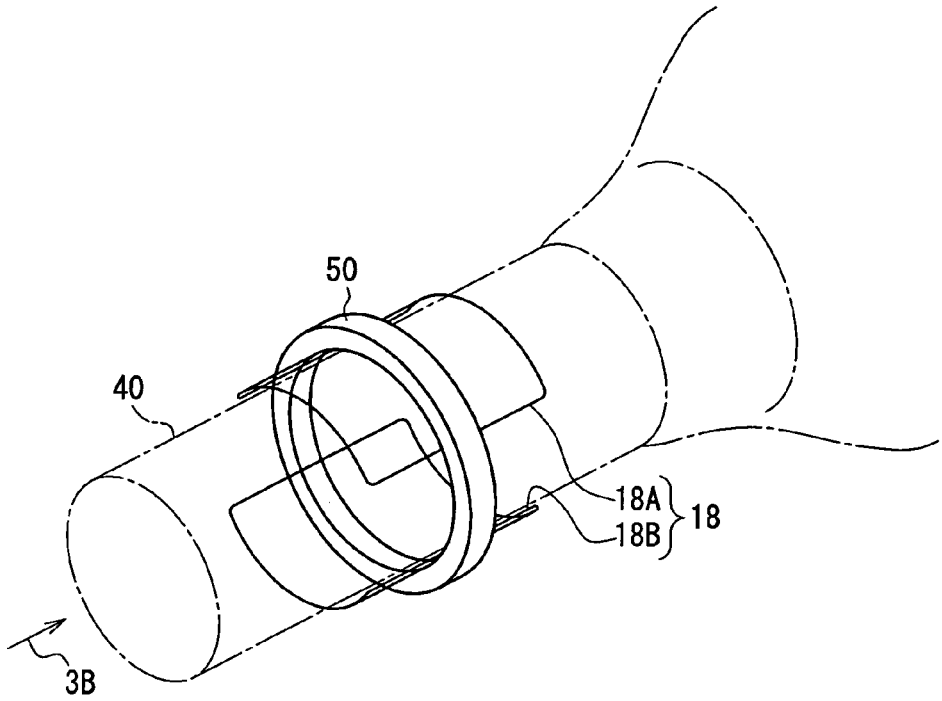
FIG. 3A is a perspective view schematically showing a configuration of a velocity modulation coil.
Figure 3B:
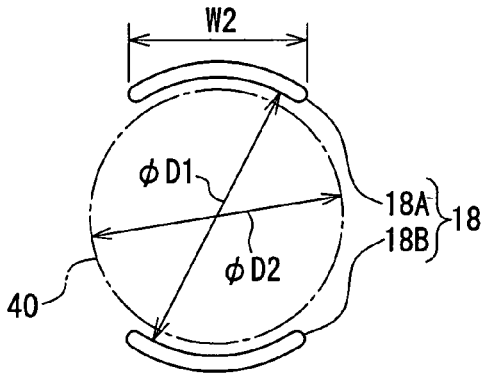
FIG. 3B is a front view of the velocity modulation coil seen in a direction of an arrow 3B along a tube axis shown in FIG. 3A.
Figure 3C:
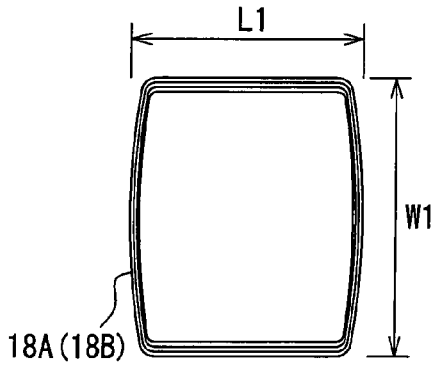
FIG. 3C is a developed plan view of a loop coil constituting the velocity modulation coil.

FIG. 3A is a perspective view schematically showing a configuration of the velocity modulation coil 18. FIG. 3B is a plan view of the velocity modulation coil 18 seen in a direction of an arrow 3B along the tube axis shown in FIG. 3A. FIG. 3C is a developed view of the coils 18A, 18B constituting the velocity modulation coil 18 developed on a plane.

One example of the velocity modulation coil 18 will be described. The coils 18A, 18B have a configuration in which a copper wire coated with polyurethane with a wire diameter of 0.4 mm is wound four turns in a substantially rectangular shape, and as shown in FIG. 3A, they are placed so as to be opposed to each other in a vertical direction under the condition that a pair of opposed sides of each coil are bent along an outer circumferential shape of the neck 40. The size of the coils 18A, 18B under the condition of being developed on a plane as shown in FIG. 3C is as follows: a length L1 of respective sides placed substantially parallel to the tube axis direction is, for example, 25 mm, and a width W1 between the sides is, for example, 35 mm. In this case, a width W2 when the coils 18A, 18B are attached to the resin frame 42 along a virtual cylindrical surface with a diameter D1 of ϕ33 mm shown in FIG. 3B is about 30 mm. D2 denotes the outer diameter of the neck 40, and D1>D2 is satisfied. A current in accordance with a velocity modulation signal obtained by differentiating a video signal is allowed to flow through the velocity modulation coil 18.

As shown in FIG. 3A, a magnetic substance ring (first magnetic substance) 50 in an annular shape is provided externally on the neck 40 of the color cathode-ray tube 12 from outside the velocity modulation coil 18. The magnetic substance ring 50 is, for example, a sintered body of Ni—Zn ferrite type magnetic substance powder, and the specific resistance of the sintered boy is $1\times10^4\Omega\cdot$m. The magnetic substance ring 50 has, for example, an inner diameter of 38 mm, an outer diameter of 44 mm, and a height or thickness (i.e., size in the tube axis direction) of 4 mm.

Furthermore, the magnetic substance ring 50 is attached to the resin frame 42 as shown in FIG. 2A, and a position of the magnetic substance ring 50 in the tube axis direction corresponds to a gap between the G5B electrode and the G6 electrode. More specifically, the magnetic substance ring 50 is provided so as to surround the color cathode ray tube 12 from outside the velocity modulation coil 18 at the position in the tube axis direction corresponding to the gap between the G5B electrode and the G6 electrode.

Furthermore, as shown in FIG. 2A, a magnetic substance ring (second magnetic substance) 60 is provided separately from the magnetic substance ring 50 so as to surround the color cathode-ray tube 12 at an end of the resin frame 38 of the deflection yoke 14 on the electron gun 24 side. The magnetic substance ring 60 is, for example, a sintered body of Ni—Zn ferrite type magnetic substance powder, and the inner diameter, outer diameter, height or thickness, and specific resistance thereof may be substantially the same as those of the magnetic substance ring 50.

Figure 4A:
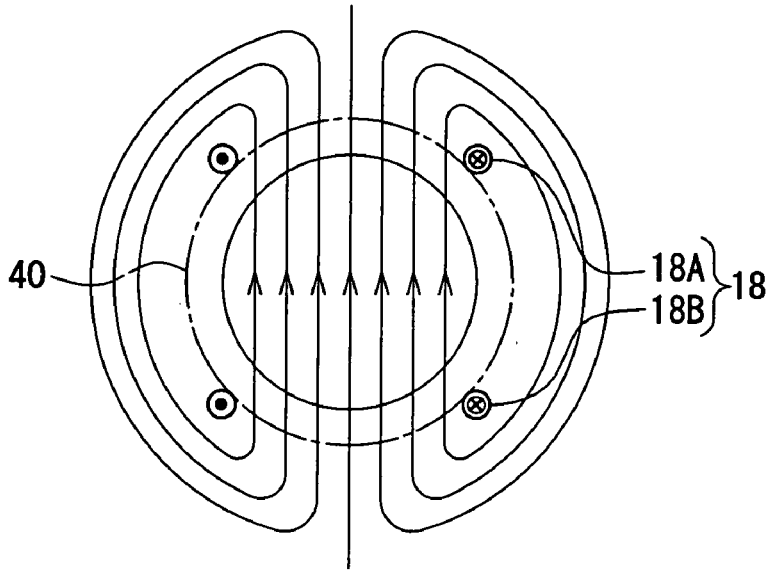
FIG. 4A PRIOR ART
FIG. 4A shows the state of a magnetic flux in the case where a magnetic substance ring is not provided.
Figure 4B:
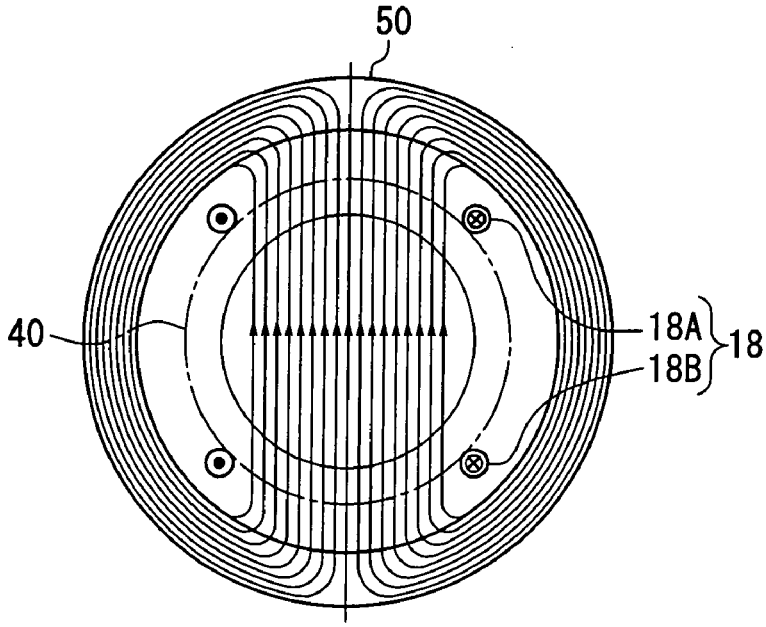
FIG. 4B shows the state of a magnetic flux in the case where the magnetic substance ring is provided.

Owing to the use of the magnetic substance ring 50, the density of a magnetic flux acting on the electron beams 30 in the neck 40 can be increased. This will be described with reference to FIGS. 4A, 4B, and 5A to 5C. FIG. 4A shows the state of a magnetic flux generated in the case where the magnetic substance ring 50 is not provided. FIG. 4B shows the state of a magnetic flux generated in the case where the magnetic substance ring 50 is provided. FIGS. 4A and 4B both schematically show a magnetic flux in a plane vertical to the tube axis, which crosses the velocity modulation coil 18.

As is understood from the comparison between FIGS. 4A and 4B, when the magnetic substance ring 50 is provided, a magnetic flux is concentrated in an inside region (electron beam passage region in the neck 40) of the magnetic substance ring 50 due to a so-called core effect. Therefore, the density of a magnetic flux acting on electron beams is increased.

Furthermore, in the tube axis direction, the magnetic substance ring 50 is provided at a position corresponding to the gap between the electrode (G5B electrode) and the electrode (G6 electrode) constituting the electron gun 24. Therefore, the influence of the loss caused by an eddy current in the electrodes can be minimized, and a magnetic field region can be enlarged. Thus, the sensitivity of velocity modulation can be enhanced effectively.

Figure 5A:
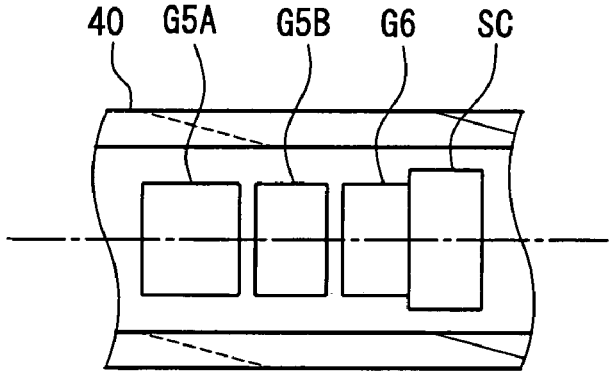
FIG. 5A is a schematic cross-sectional view of a neck from the vicinity of a G5A electrode to the vicinity of a shield cup SC.
Figure 5B:
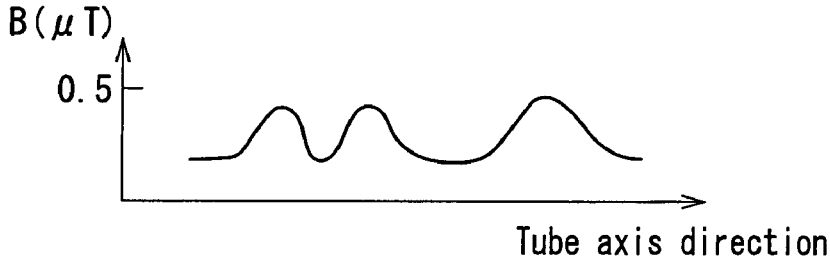
FIG. 5B is a diagram showing results obtained by measuring a change in the density of a magnetic flux in the case where a magnetic substance ring 50 is not provided.
Figure 5C:
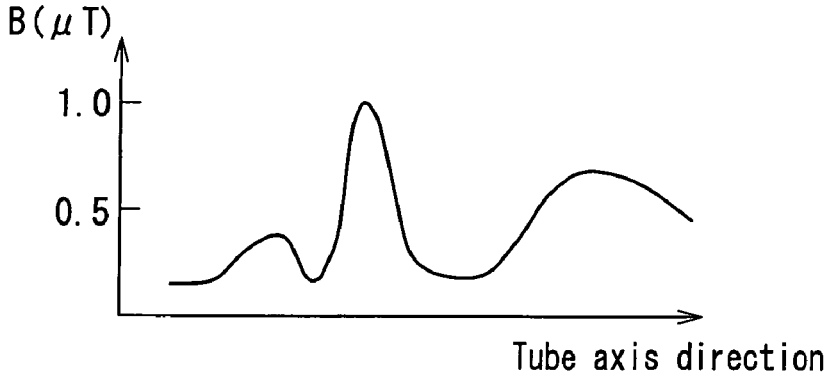
FIG. 5C is a diagram showing the results obtained by measuring a change in the density of a magnetic flux in the case where the magnetic substance ring 50 is provided.

FIG. 5A is a schematic cross-sectional view of the neck from the vicinity of the G5A electrode to the vicinity of the shield cup SC. FIGS. 5B and 5C show results, which are obtained by measuring a change in the density of a magnetic flux generated by the velocity modulation coil 18 along the tube axis, so that the position in the horizontal direction corresponds to that in FIG. 5A. FIG. 5B is a diagram showing measurement results in the case where the magnetic substance ring 50 is not provided, and FIG. 5C is a diagram showing measurement results in the case where the magnetic substance ring 50 is provided.

According to the measurement results shown in FIG. 5B, it is understood that the density of a magnetic flux decreases in a section where an electrode is present, compared with the section where an electrode is not present (gap portion between the electrodes), due to the loss caused by an eddy current generated by the electrodes. The reason why the sensitivity of velocity modulation is not so enhanced as expected in the conventional configuration is that an attempt is made to increase the decreased density of a magnetic flux. According to the measurement results shown in FIG. 5C, it is understood that, owing to the use of the magnetic substance ring 50, the density of a magnetic flux in the gap between the G5B electrode and the G6 electrode becomes about double, and a magnetic field region extends to the screen side of the electron gun. More specifically, according to this configuration, the sensitivity of velocity modulation can be enhanced effectively FIG. 6 is a graph showing the results of a comparison test of the sensitivity of velocity modulation among the case of an air core in the absence of the magnetic substance ring 50 (line 60), the case of using the magnetic substance ring 50 made of a sintered body of NiZn type ferrite (line 61), and the case of using the magnetic substance ring 50 made of a sintered body of MgZn type ferrite (Line 62).

Figure 6:
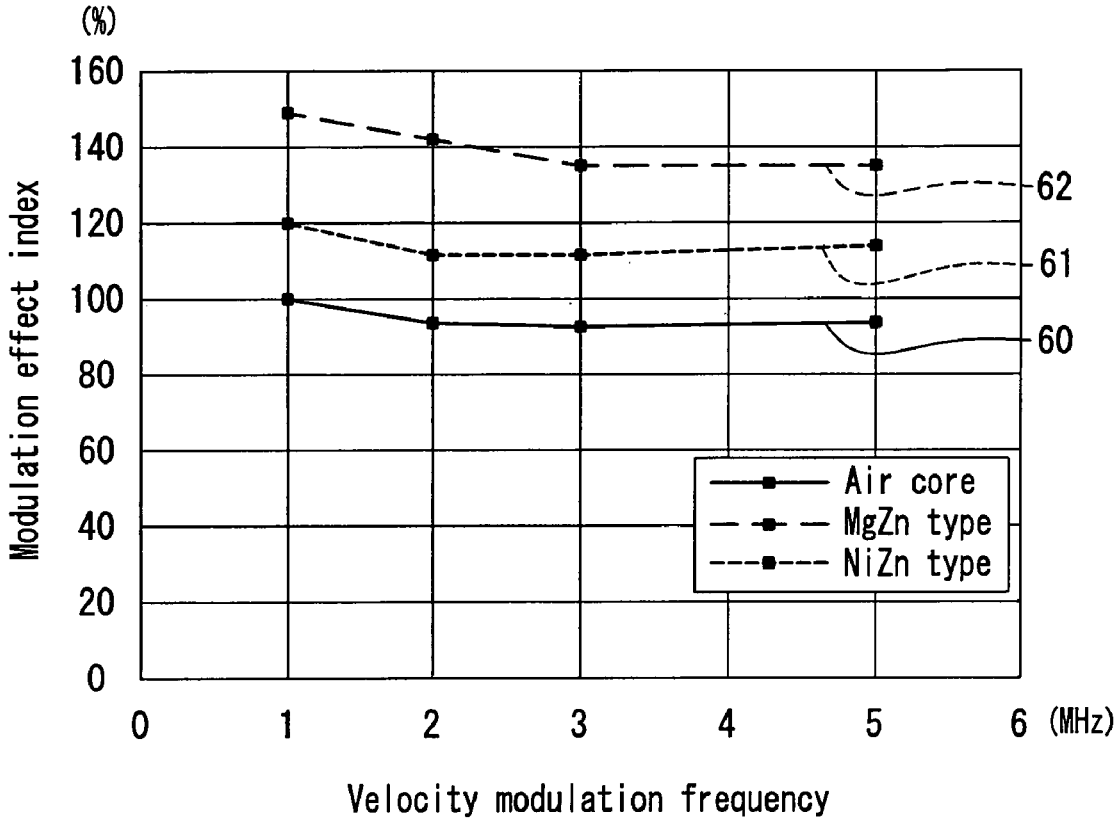
FIG. 6 is a diagram showing results of a comparison test of the sensitivity of velocity modulation.

In FIG. 6, a horizontal axis represents a frequency of a velocity modulation signal (hereinafter, referred to as a "velocity modulation frequency") applied to the velocity modulation coil 18. A vertical axis represents relatively a displacement amount (hereinafter, referred to as a "beam displacement amount") in a horizontal direction of an electron beam spot having a 5% brightness diameter (spot diameter of an electron beam obtained by removing a part of 5% or less from the lowest brightness, assuming that a brightness peak of an electron beam spot is set to be 100%) at the center portion of the phosphor screen. More specifically, the vertical axis represents a relative beam displacement amount, with the beam displacement amount in the case of an air core at a velocity modulation frequency of 1 MHz being 100%. Furthermore, in the comparison test, the amount of a current flowing to the velocity modulation coil was set to be constant q.e., 0.8 A) in all of the cases.

As shown in FIG. 6, it is understood that, in a range of 1 to 5 MHz of the velocity modulation frequency, in the case of using the MgZn type magnetic substance ring (line 62), the velocity modulation effect can be enhanced by 1.5 times, compared with the case of an air core (line 60). Furthermore, even in the case of using the NiZn type magnetic substance ring 50 dine 61), the velocity modulation effect can be enhanced by 1.2 times, compared with the case of an air core (line 60).

It is understood from FIG. 5B that, even in the case where the magnetic substance ring 50 is not used, more magnetic fluxes are generated in the gap between the electrodes, compared with the section in which an electrode is present, on the tube axis. Therefore, a procedure of increasing gaps by dividing electrodes only for the purpose of generating more magnetic fluxes as a whole in the electron beam passage region in the section in which the electron gun is present has been adopted in the conventional example. In this case, the increase in the number of components and the increase in the number of assembly processes necessitate the increase in the cost of the electron gun. In contrast, according to the present embodiment, the density of a magnetic flux in an electron beam passage region can be increased effectively as described above, without adopting such a procedure.

Figure 2B:
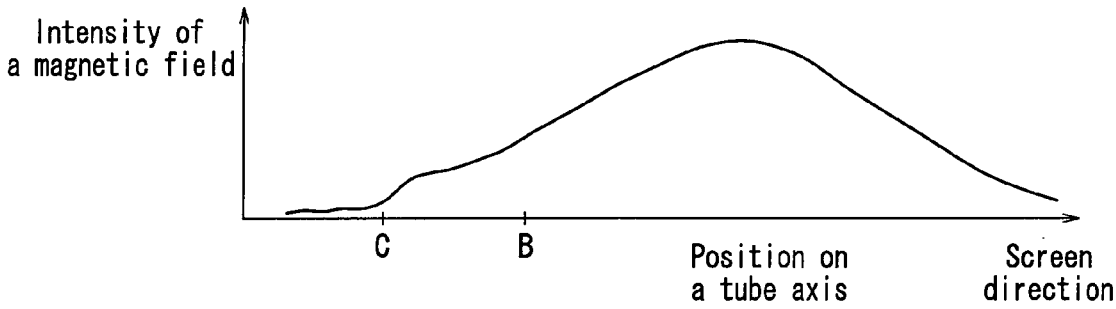
FIG. 2B shows the state of a magnetic field in the case where a magnetic substance ring 60 is not provided.
Figure 2C:
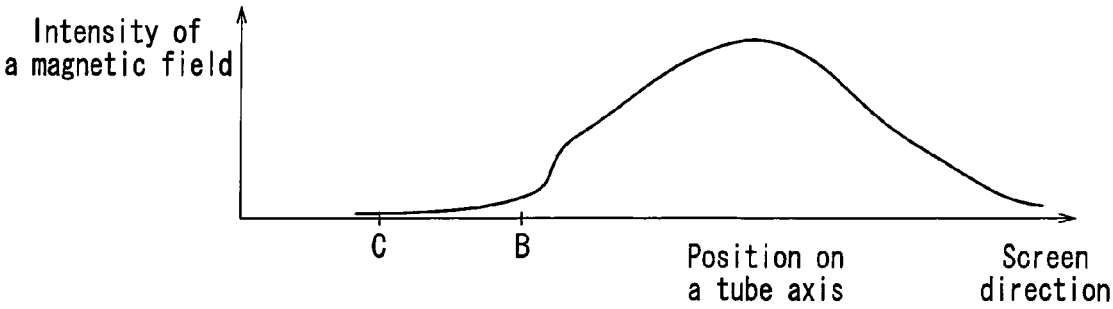
FIG. 2C shows the state of a magnetic field in the case where the magnetic substance ring 60 is provided.

Next, FIG. 2B shows a magnetic field generated by the deflection yoke 14 in the case where the magnetic substance ring 60 is not present. FIG. 2C shows a magnetic field generated by the deflection yoke 14 in the case where the magnetic substance ring 60 is provided. A vertical axis in each figure represents the intensity of a magnetic field, and a horizontal axis in each figure represents a position on the tube axis. A point B on the horizontal axis is a position corresponding to the magnetic substance ring 60 in FIG. 2A, and a point C is a position corresponding to the magnetic substance ring 50 in FIG. 2A.

As shown in FIG. 2B, the magnetic field generated by the deflection yoke 14 extends to the electron gun 24 side, and owing to the presence of the magnetic substance ring 50, the distribution of the intensity of a magnetic field is changed at the point C. Thus, the change in the distribution of the intensity of a magnetic field is varied depending upon the attachment position of the magnetic substance ring 50 and the attachment position of the CPU 16. Furthermore, the change in the distribution of the intensity of a magnetic field also is varied depending upon the material and shape of the magnetic substance ring 50. Consequently, distortion occurs in the deflection function of the electron beams.

On the other hand, as shown in FIG. 2C, owing to the presence of the magnetic substance ring 60, the magnetic field spreading to the electron gun 24 side is weakened, and the change in the distribution of the intensity of a magnetic field caused by the influence of the magnetic substance ring 50 is small. Thus, in the case of designing a deflection yoke while considering the influence of the magnetic substance ring 60, deflection distortion caused by the magnetic substance ring 50 can be prevented from occurring, whereby the velocity modulation effect can be enhanced.

As described above, in the color cathode-ray tube apparatus according to the present embodiment, the magnetic substance ring 50 surrounding the outer circumference of the cathode-ray tube is provided at a position in the tube axis direction corresponding to the gap between an electrode (G5B electrode) among the electrodes in the electron gun and another electrode (G6 electrode) adjacent thereto, from outside the velocity modulation coil 18. Owning to the magnetic substance ring 50, the density of a magnetic flux generated in the velocity modulation coil 18 can be enhanced. Furthermore, by providing the magnetic substance ring 50 at a position corresponding to the gap of a plurality of electrodes that are metal components, the loss of the magnetic flux generated in the velocity modulation coil 18, caused by an eddy current, can be reduced. Thus, the sensitivity of velocity modulation can be enhanced.

Furthermore, the magnetic substance ring 60 is provided at an end of the deflection yoke 14 on the electron gun side so as to surround the outer circumference of the cathode-ray tube. This prevents the deflection magnetic field generated from the deflection yoke 14 from extending to the electron gun side. Thus, even if the magnetic substance ring 50 is provided, the distribution of a deflection magnetic field generated from the deflection yoke 14 hardly changes. Thus, the magnetic flux generated in the velocity modulation coil 18 is concentrated in the gap between electrodes by the magnetic substance ring 50 while the occurrence of deflection distortion is suppressed, whereby the sensitivity of velocity modulation can be enhanced.

Figure 7:
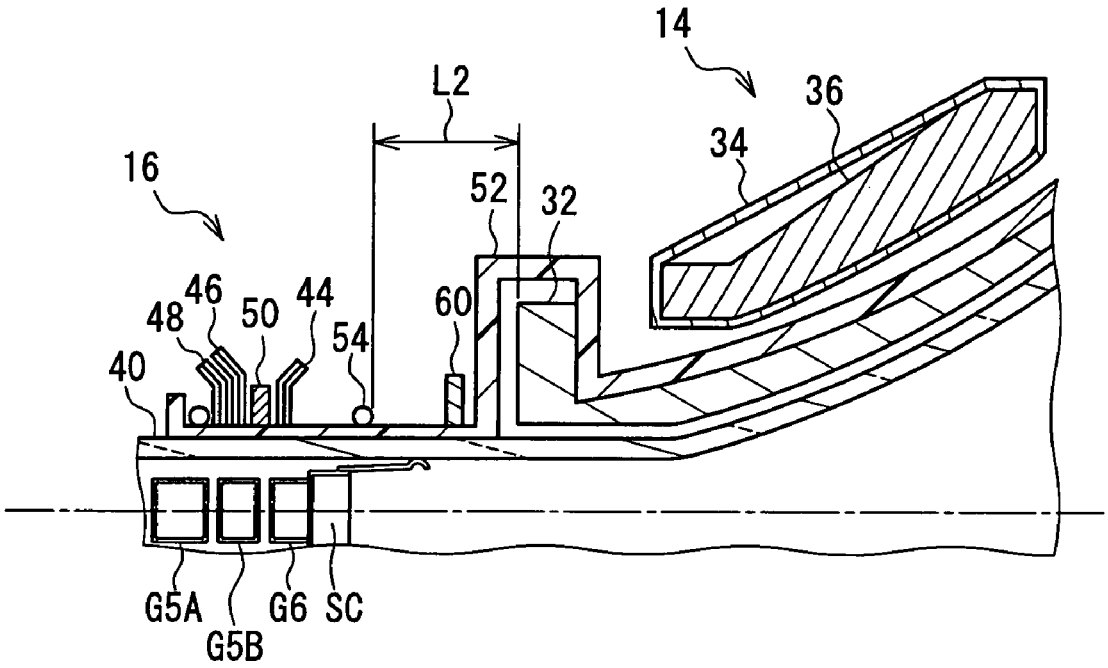
FIG. 7 is an enlarged cross-sectional view of a neck and the vicinity thereof in a color cathode-ray tube apparatus of a modified example.

FIG. 7 shows a configuration of main portions according to another embodiment of the present invention. In the previous embodiment, an example in which the velocity modulation coil 18 and the magnetic substance ring 50 are integrated with the CPU 16, and attached thereto separately from the deflection yoke 14 has been described. In FIG. 7, a velocity modulation coil 54 and a magnetic substance ring 50 are integrally attached to the deflection yoke 14.

As shown in FIG. 7, a resin frame 52 insulates the horizontal deflection coil 32 from the vertical deflection coil 36 in the same way as in the resin frame 38 shown in FIG. 2A, and supports both the deflection coils 32, 36. However, the resin frame 52 shown in FIG. 7 extends in the tube axis direction to a portion of the neck 40 where the electron gun is placed, unlike the resin frame 38 shown in FIG. 2A. The velocity modulation coil 54 and the magnetic substance ring 50 are attached to this extension portion. Furthermore, in FIG. 7, a purity magnet 44, a quadrupole magnet 46, and a hexapole magnet 48 constituting the CPU 16 also are attached to the resin frame 52. More specifically, according to the configuration shown in FIG. 7, it also can be considered that the CPU 16 and the deflection yoke 14 are provided integrally.

Furthermore, in the velocity modulation coil 54 shown in FIG. 7, an end of the velocity modulation coil 54 on the phosphor screen side extends to the horizontal deflection coil 32 side, more than the velocity modulation coil 18 shown in FIG. 2A. More specifically, a distance L2 between the velocity modulation coil 54 and the horizontal deflection coil 32 is smaller than that in the configuration shown in FIG. 2A. Consequently, the velocity modulation coil 54 extends to the phosphor screen side in the tube axis direction, beyond an end of the shield cup SC on the phosphor screen side. The purpose for this is to generate a magnetic flux of the velocity modulation coil 54 in an electron beam passage section (section where metal components (electrodes, shield cup, etc.) are not present) corresponding to the extension portion, thereby enhancing the sensitivity of velocity modulation even in a small amount.

In the case where the magnetic substance ring 60 is not present, when the velocity modulation coil 54 and the horizontal deflection coil 32 are placed too close to each other, the magnetic field generated by the velocity modulation coil 54 and the magnetic field generated by the horizontal deflection coil 32 interfere with each other excessively, whereby so-called ringing is likely to occur in an image on the phosphor screen. In the present embodiment, the following was confirmed: since the magnetic substance ring 60 is provided, the magnetic field generated from the velocity modulation coil 54, which extends off on the screen side with respect to the electron gun side, is blocked by the magnetic substance ring 60, so that problematic ringing does not occur.

In the present embodiment, an example in which the magnetic substance ring 50 is provided at the position corresponding to the gap between the G5 electrode and the G6 electrode has been described. The reason for this is that the main lens is formed in the gap between these two electrodes, and in general (even in the present embodiment), the gap between the electrodes forming the main lens is larger than that between any other electrodes.

However, the magnetic substance ring 50 may be provided at a position corresponding to a gap between other electrodes. This is because a magnetic flux can be concentrated in an electron beam passage region as long as the magnetic substance ring 50 is provided at a position corresponding to a gap between an electrode and another electrode adjacent thereto.

In the example shown in FIG. 2A, one magnetic substance ring 50 surrounds the outer circumference of the cathode-ray tube from outside the velocity modulation coil 18. However, in the present invention, the number of the magnetic substance ring 50 is not limited to one. A plurality of magnetic substance rings may be prepared and arranged so as to correspond to a plurality of gaps between electrodes, respectively. This further increases the density of a magnetic flux in the entire electron beam passage region, and enhances the sensitivity of velocity modulation.

Furthermore, an example in which the shape of the magnetic substance ring 50 has an annular shape has been described. However, the magnetic substance ring 50 may be formed in a square frame shape, and may be formed in a polygonal (pentagonal or more) frame shape. In this case, in order to maintain the symmetry of a magnetic flux generated in the neck, it is preferable that the magnetic substance ring 50 is formed in a regular polygonal frame shape.

Furthermore, an example in which the magnetic substance ring 50 has a closed annular shape has been described. However, the magnetic substance ring 50 may be formed in a "C"-shape by cutting away a part of the annular shape, and two or more parts may be cut away from the annular shape. The above-mentioned effect can be exhibited as long as the magnetic substance ring 50 has a shape substantially surrounding the gap between electrodes from the outer circumference of the color cathode-ray tube (neck portion).

An example in which a sintered body of Ni—Zn ferrite is used for the magnetic substance ring 50 has been described. However, a sintered body of Mg—Zn ferrite may be used. Furthermore, a magnetic substance ring obtained by molding resin mixed with the above-mentioned ferrite powder may be used, as well as a sintered body. According to this configuration, compared with the case of using a sintered body, the cost can be reduced.

The above-mentioned various configurations of the magnetic substance ring 50 can be applied similarly to the magnetic substance ring 60 placed between the magnetic substance ring 50 and the deflection coil.

As described above, according to the present invention, the sensitivity of velocity modulation can be enhanced effectively with a simple configuration while deflection distortion is prevented. Therefore, the present invention is useful as a cathode-ray tube apparatus used, for example, in a TV receiver, a computer display, and the like.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A cathode-ray tube apparatus, comprising a cathode-ray tube in which an electron gun is housed and a phosphor screen is formed, and a deflection coil for deflecting an electron beam emitted from the electron gun, provided outside the cathode-ray tube, the apparatus further comprising a velocity modulation coil for modulating a horizontal scanning velocity of the electron beam, a first magnetic substance surrounding an outer circumference of the cathode-ray tube from outside the velocity modulation coil, and a second magnetic substance surrounding the outer circumference of the cathode-ray tube, placed between the deflection coil and the first magnetic substance.

2. The cathode-ray tube apparatus according to claim 1, wherein the first and second magnetic substances are formed in an annular shape.

3. The cathode-ray tube apparatus according to claim 1, wherein the first magnetic substance is placed at a position corresponding to a gap between electrodes forming a main lens in the electron gun.

4. The cathode-ray tube apparatus according to claim 1, wherein a support frame for supporting the deflection coil extends to a portion where the electron gun is placed in a tube axis direction, and the first magnetic substance, the second magnetic substance, and the velocity modulation coil are attached to the support frame.

5. The cathode-ray tube apparatus according to claim 1, wherein an end portion of the velocity modulation coil on the phosphor screen side is positioned on the phosphor screen side with respect to an end on the phosphor screen side of a metal portion constituting the electron gun.

6. The cathode-ray tube apparatus according to claim 1, wherein the second magnetic substance is placed closer to the deflection coil than to the first magnetic substance.

7. The cathode-ray tube apparatus according to claim 1, wherein the first magnetic substance is a sintered body of Ni—Zn ferrite.

8. The cathode-ray tube apparatus according to claim 1, wherein the first magnetic substance is resin mixed with Ni—Zn ferrite type magnetic substance powder.

9. The cathode-ray tube apparatus according to claim 1, wherein the second magnetic substance is a sintered body of Ni—Zn ferrite.

10. The cathode-ray tube apparatus according to claim 1, wherein the second magnetic substance is resin mixed with Ni—Zn ferrite type magnetic substance powder.

* * * * *